United States Patent [19]

Cunningham

[11] Patent Number: 4,462,494

[45] Date of Patent: Jul. 31, 1984

[54] MULTI-PACKAGING DEVICE FOR CYLINDRICAL CONTAINERS

[75] Inventor: Ernest R. Cunningham, Libertyville, Ill.

[73] Assignee: Grip-Pak, Inc., St. Louis, Mo.

[21] Appl. No.: 460,139

[22] Filed: Jan. 24, 1983

[51] Int. Cl.[3] ..... B65D 71/00

[52] U.S. Cl. ..... 206/150; 206/158; 206/161; 294/87.2

[58] Field of Search ..... 206/145, 147, 150, 151, 206/158, 161, 199, 427, 428; 294/87.2

[56] References Cited

U.S. PATENT DOCUMENTS

| | | | |
|---|---|---|---|
| 2,936,070 | 5/1960 | Poupitch | 206/150 |
| 3,268,070 | 8/1966 | Cunningham | 206/150 |
| 3,307,321 | 3/1967 | Beart | 294/87.2 |
| 3,374,028 | 3/1968 | Wanderer | 206/150 |
| 3,874,502 | 4/1975 | Weaver | 206/161 |
| 4,033,457 | 7/1977 | Weaver | 206/150 |
| 4,109,787 | 8/1978 | Klygis et al. | 206/150 |
| 4,121,712 | 10/1978 | Cunningham | 206/158 |
| 4,149,631 | 4/1979 | Cunningham | 206/158 |
| 4,219,117 | 8/1980 | Weaver et al. | 206/150 |
| 4,356,914 | 11/1982 | Olsen et al. | 206/150 |

*Primary Examiner*—George E. Lowrance
*Assistant Examiner*—Jimmy G. Foster
*Attorney, Agent, or Firm*—Michael Kovac

[57] ABSTRACT

A multi-packaging device for cylindrical containers formed from stretchable and elastic plastic material is disclosed as having a plurality of container encircling bands with generally D-shaped hole configurations for a tight and compact package and including means providing uniform and equal separation of adjacent bands from each other, and deflectable finger tab means for easy gripping thereof by a user for carrying containers.

7 Claims, 5 Drawing Figures

MULTI-PACKAGING DEVICE FOR CYLINDRICAL CONTAINERS

SUMMARY OF THE INVENTION

Stretchable and elastic plastic sheet multi-packaging devices which are formed an unsupported sheet of resilient, elastic and deformable material such as low density polyethylene are well known in the art as shown from expired U.S. Pat. No. 2,874,835. Such multi-packaging devices are widely and successfully utilized in the packaging of a plurality of containers to form 6-pack, 8-pack and other multi-package sizes.

Various forms of multi-packaging devices have been produced with different hole configurations including circular and elliptical designs as shown in U.S. Pat. Nos. 2,874,835 and 4,121,712; combinations of circular and elliptical designs as shown in U.S. Pat. No. 2,989,177; interrupted hole designs as shown in U.S. Pat. No. 2,936,070, non-symmetrical oblong designs as shown in U.S. Pat. No. 3,874,502; and polygonal configurations as shown in U.S. Pat. No. 4,219,117. While each of the abovementioned designs have worked well for the intended purpose in producing reliable multi-packaging devices, the hole shape has been largely determined by carrier applicating machines and methods. Where carrier applicating machines with pairs of laterally opposing jaws or progressively applying pins are used, the hole designs have tended toward elliptical shapes such as shown in U.S. Pat. No. 4,121,712 or non-symmetrical oblong designs such as shown in U.S. Pat. No. 3,874,502. Where carrier applicating equipment applies a lateral stretching force on the outer bands, as is the case with newly developed machines and equipment, polygonal hole configurations such as shown in U.S. Pat. No. 4,219,117 can be employed.

The present invention has been developed for use with applicating machines which apply a lateral stretching force, and for this purpose, has a generally D-shaped hole configuration in each band that is different from the polygonal hole configurations described above, but nonetheless can be quickly and efficiently applied by the lateral stretching force carrier applicating equipment to produce a tight compact package.

Various finger gripping tab designs have also been employed over the years, while trying to minimize material usage. In my U.S. Pat. No. 4,149,631, for example, there is shown one type of such aforementioned multi-packaging device in which generally diamond-shaped openings are provided between adjacent connected pairs of bands to facilitate insertion of a user's fingers into the generally diamond-shaped openings of the multi-packaging device, when assembled to containers, for carrying same. The user's fingers engage inner marginal edge portions of the multi-packaging device in the vicinity of the generally diamond-shaped openings for lifting and carrying the containers. In so doing, the user's fingers come essentially into line contact with the inner marginal edge portions of the generally diamond-shaped openings. For some users, this may create a mild irritation or sensation by the essentially line contact engagement, although this is not a problem with all users. However, it would be desirable to have such a multi-packaging device where all users find it comfortable and easy to grip and lift the containers.

In several prior art patents, including U.S. Pat. Nos. 3,711,145; 3,733,100; and 3,874,502, there are projecting deflectable finger tab means associated with a multi-packaging device; however, there is no efficient utilization of material, such as by the use of generally diamond-shaped openings as shown in my aforementioned U.S. Pat. No. 4,149,631. Further, none of the patents employing projecting deflectable finger tab means enable a user's fingers to be freely and easily inserted without first engaging the deflectable finger tab means. This makes it difficult to carry the package from the side or end.

Another difficulty associated with such prior art devices is that the cutting operation that separates multi-packaging devices after assembly to cans, also produces an uneven and unequal cut or spearation in the longitudinal connecting webs joining adjacent bands in the multi-packaging device. This is due to mis-adjustment and/or non-sharpening of the cutting knives, and this is quite common. The results is that the bands holding the outside cans in a multi-package could become weakened and cause disassociation of cans from the multi-package. An attendant problem is that the gouged-out areas or tail extensions of the band create an unsightly condition.

Accordingly, it is an object of the present invention to provide a multi-packaging device for cylindrical containers with a unique hole configuration for quick and efficient application to containers to produce a tight and compact package.

Another object of the present invention is to provide a multi-packaging device for cylindrical containers with a new and improved deflectable finger tab means for easy gripping and carrying of containers associated therewith.

Still another object of the present invention is to provide means facilitating uniform and equal separation of the multi-packaging devices from each other.

Other objects of the present invention are to provide multi-packaging devices of the aforementioned type which efficiently utilize material to produce a low cost multi-packaging device.

These and other objects and advantages of the present invention will become more apparent from the ensuing description.

DESCRIPTION OF THE PREFERRED EMBODIMENTS

Figure 1:
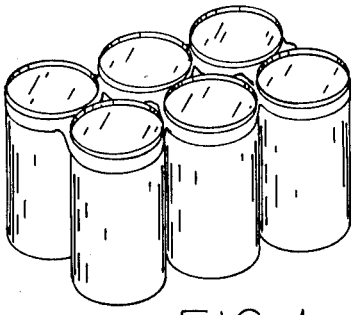
FIG. 1 is a perspective view of the multi-packaging device of the present invention assembled to cylindrical containers to form a multi-package.
Figure 2:
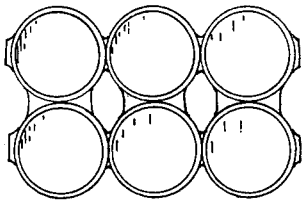
FIG. 2 is a top plan view of the multi-package shown in FIG. 1.
Figure 3:
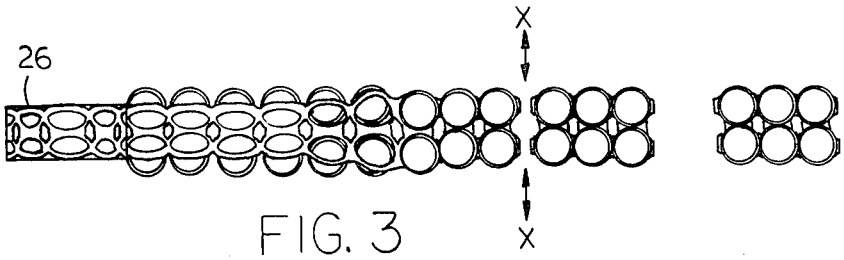
FIG. 3 is a schematic top plan view of an assembly operation showing multi-packaging devices of the present invention assembled to containers and then separated from one another to form multi-packages.

For purposes of the ensuing description, it is to be understood that the term "stretchable and elastic material" includes resilient, deformable and elastic plastic material such as low density polyethylene or other equivalent material; the term "container" includes can and bottle products of any size and of generally cylindrical shape; and the term "package" or "multi-package" includes a plurality of containers held together by a multi-packaging device such as the well known 6-pack, 8-pack, and the like.

The multi-packaging device 10 shown in FIGS. 1–4 of the drawings is formed from stretchable and elastic material, and comprises an endless series of laterally connected container encircling bands 12 arranged in two longitudinal rows which are joined to adjacent bands 12 between the longitudinal rows by lateral connecting webs 14 to provide a plurality of laterally connected pairs of bands 12. Each laterally connected pair of bands 12 is joined to an adjacent pair of laterally connected bands 12 by longitudinal connecting webs 16 in each longitudinal row, as can be seen.

Each of the container encircling bands 12 of the multi-packaging device 10 has an outer marginal section or band segment 18, extending between adjacent longitudinal connecting webs 16, and inner marginal sections or band segments 20,20 extending from adjacent longitudinal connecting webs 16 to its associated lateral connecting web 14 and being on the opposite sides thereof.

To facilitate assembly of the multi-packaging device 10 to containers, the lateral connecting webs 14 have a longitudinal fold or weakened line 22 in the central portion thereof, while the longitudinal connecting webs 16 have a transversely directed slit 24. It will be noted that the longitudinal fold line 22 of the lateral connecting webs 14 and the transversely directed slit 24 of the longitudinal connecting webs 16 extend through substantial portions thereof. This facilitates assembly of the multi-packaging device 10 to containers since each individual band 12 is somewhat independently flexible and/or foldable relative to the other bands 12 in the multi-packaging device 10. With independent flexibility and/or foldability, the multi-packaging device 10 can assist the components of the assembly machine by enabling individual bands 12 to self-adjust or self-accommodate to the out-of-adjustment elements of the assembly machine.

The transversely directed slit 24 also serves a very important function in assuring uniform and equal separation of adjacent multi-packaging devices 10 from each other. As shown in the schematic assembly view of FIG. 3, a roll of multi-packaging devices 10 is unwound and assembled to containers by any well known assembly machine (not shown). After assembly to containers, the adjacent multi-packaging devices 10 are separated from each other by cutting knives shown schematically by the arrows X which are reciprocated at the precise instant necessary to cut the longitudinal connecting webs 16 in each longitudinal row to form a multi-package, as shown on the right hand side of FIG. 3.

Due to mis-adjustment or dulling of the cutting knives, it is well known that gouged-out portions or tail extensions are formed in the outermost bands 12 of the multi-packaging device 10 as a result of the cutting operation, thus producing a weakened and unsightly area in the bands 12 at the ends of the multi-package.

To overcome this prior art problem, it will be noted that the transversely directed slit 24 is centrally disposed between adjacent bands 12, and is spaced from opposite marginal portions of the longitudinal connecting web 16. Thus, when adjacent bands 12 in the longitudinal rows are separated from each other to form multi-packs, the transversely directed slits 24 cause the separating or cutting forces to follow the path of least resistance which is the transversely directed slit 24 itself. The unslit areas of the longitudinal connecting webs 16 which are cut by the cutting knives may or may not be in alignment with the transversely directed slit 24; however, in any case, they will not have any significant gouged-out portions or tail extensions, as in prior art designs.

In the area between adjacent pairs of laterally connected bands 12, there is provided generally diamond-shaped openings 28 to enable a user's fingers to be freely and easily inserted therebetween, without any interference. The generally diamond-shaped openings 28 are formed by adjacent inner marginal sections (four such inner marginal sections 20) for each generally diamond-shaped opening 28, lateral connecting webs 14 (two for each generally diamond-shaped opening 28), and longitudinal connecting webs 14 (two for each diamond-shaped opening 28). Each diamond-shaped opening 28 has at least two rounded concave inner marginal end portions 30 in the vicinity of the inner marginal portions of the longitudinal connecting webs 16, and deflectable finger tab means 32 in the vicinity of the lateral connecting webs 14.

At least one pair of laterally connected bands 12 is provided with a pair of transversely extending deflectable tab means 32 which comprise integral outer marginal portions of an associated lateral connecting web 14 on opposite sides thereof. As shown in the drawings, each pair of laterally connected bands 12 is provided with deflectable finger tab means to provide a multi-packaging device 10 with a group of two or more transverse pairs of container bands 12, as is well known.

Figure 4:
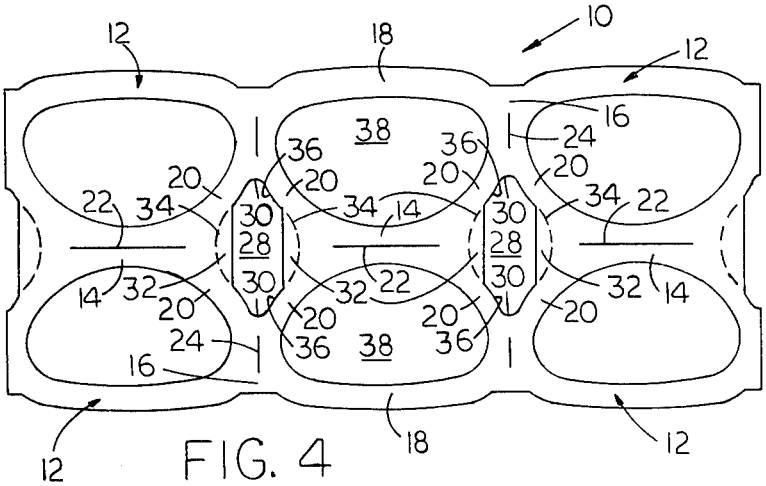
FIG. 4 is an enlarged top plan view of the multi-packaging device that is constructed in accordance with the teachings of the present invention.

As is best seen in FIG. 4, the deflectable finger tab means 32 do not longitudinally project or extend into the diamond-shaped openings 28, as is the case of prior art devices which require this in order to have deflection of the finger tab means. In the case of the present invention, the deflectable finger tab means 32 is obtained by the provision of a curvilinear perforation 34 which comprises a perforated extension or weakened line of the inner marginal edges 36 of the inner band sections 20 on each side of an associated lateral connecting web 14. Note particularly that when the multi-packaging device 10 is assembled to containers, the inner marginal edges 36 of the of the inner band sections 20 will lie in close proximity to the containers, and this enables the deflectable finger tab means 32, with associated curvilinear perforation 34, to be deflected upwardly or downwardly, depending on the grasping technique of the user's fingers. Line contact with the edges of the multi-packaging device is thereby avoided. In addition, a user's fingers can be freely inserted within the generally diamond-shaped opening, without first engaging the deflectable finger tab means 32. This facilitates carrying the multi-package from where the user squeezes a pair of deflectable finger tab means 32, and then deflects them downwardly or upwardly depending on the method of gripping, or from the sides or end of the multi-package where a single second, third or fourth finger of a user's hand can be inserted into the generally diamond-shaped openings 28 and easily grip one of the deflectable finger tab means 32. Also, the generally diamond-shaped openings 28 save more material than other finger insertion opening designs, and thus there is more efficient utilization of material.

Figure 5:
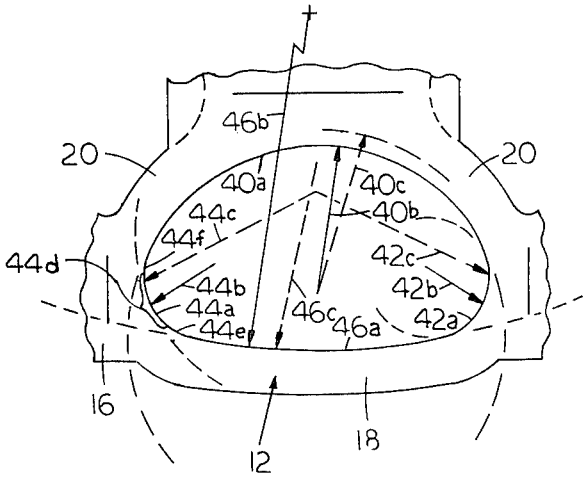
FIG. 5 is an enlarged fragmentary top plan view showing the construction of each band of the multi-packaging device.

It is to be noted that the bands 12 in the longitudinal rows have generally D-shaped openings 38 which are in mirror image relationship to the D-shaped openings 38 in the opposite longitudinal row. For a specific description of the manner in which the generally D-shaped openings 38 are formed in the bands 12 of the multi-packaging device 10, reference is made to FIG. 5. There it will be seen that the band 12 is shaped to define closed loop of four inner arcuate sections 40*a*, 42*a*, 44*a* and 46*a* which are formed by the four radii of curvatures represented by the arrows 40*b*, 42*b*, 44*b* and 44*b*, respectively. The radius of curvature of the sidewall of the containers immediately below the chime thereof is represented by the arrows 40*c*, 42*c*, 44*c* and 46*c*. Each of the arrows 40*c*, 42*c*, 44*c* and 46*c* are of the same length and represent the radius of curvature of the container and are shown in the vicinity of the four inner arcuate sections 40*a*, 42*a*, 44*a* and 46*a* so as to be directly comparable therewith.

The first inner arcuate section 40*a* is formed in the inner band segment 20 throughout its arcuate length and has a radius of curvature represented by the arrow 40*b* that is slightly smaller than the radius of curvature represented by the arrow 40*c*.

The second and third inner arcuate sections 42*a* and 44*a* are equal in arcuate length and extend from each end of the first inner arcuate section 40*a* to the fourth inner arcuate section 46*a*. It is to be noted that each of the equal second and third inner arcuate sections 42*a* and 44*a* are formed generally within the confines of a longitudinal plane extending between adjacent longitudinal connecting webs 16. The equal second and third inner arcuate sections 42*a* and 44*a* are formed by the radius of curvatures 42*b* and 44*b*, respectively, which are smaller than the radius of curvatures 42*c* and 44*c* of the containers. However, it will be seen that the equal second and third inner arcuate sections 42*a* and 44*a*, as shown by the extension of curvature of the container radius of curvature 44*c*, at the left hand side of FIG. 5, has a central portion 44*d* which generally conforms to the radius of curvature 44*c* of the containers, and two end portions 44*e* and 44*f* which have a radius of curvature smaller than the radius of curvature of the containers 44*c*, for connection and joining to the first inner arcuate sections 40*a* and 46*a*. Thus, for a major portion of the arcuate length thereof, the second and third inner arcuate sections 42*a* and 44*a* have a radius of curvature which generally conforms to the radius of curvature of the containers represented by the arrows 42*c* and 44*c*.

The fourth inner arcuate section 46*a* is formed in the outer band segment 18 throughout its arcuate length and has a radius of curvature 46*b* substantially greater than the radius of curvature 46*c* of the containers.

The total arcuate extent of the four inner arcuate sections 40*a*, 42*a*, 44*a* and 46*a* is substantially less than the circumference of the containers. Thus, upon stretching the bands 12 by the carrier applicating equipment with lateral stretching forces, the first and fourth inner arcuate sections 40*a* and 46*a* are elongated while the second and third inner arcuate sections 42*a* and 44*a* are conformed to the circumferential shape of the containers. More particularly, the central portion 44*d* of the third inner arcuate section 44*c* is generally conformed to the shape of the containers, while the outer end portions 44*e* and 44*f* are slightly elongated. The same conformation and elongation occurs with respect to the corresponding portions of the second inner arcuate section 42*a*.

The generally D-shaped openings 38 are usefully employed where applicating techniques stretch the outer band section 18 of the bands 12 and then force the remaining portions of the bands 12 over the containers to form a multi-package. A very tight and compact multi-package is also provided.

From the foregoing, it will be appreciated that the multi-packaging device of the present invention achieves advantages previously unattainable by prior art designs.

I claim:

1. A multi-packaging device for cylindrical containers which is formed from stretchable and elastic plastic material, comprising a plurality of container encircling bands arranged in two longitudinal rows which are joined to adjacent bands between the longitudinal rows by lateral connecting webs to provide a plurality of laterally connected bands, each laterally connected pair of bands being joined to an adjacent pair of laterally connected bands by longitudinal connecting webs in each longitudinal row, each of said bands having curvilinear inner marginal sections extending between adjacent longitudinal connecting webs and lateral connecting webs, adjacent pairs of laterally connected bands having finger openings therebetween defined by adjacent curvilinear inner marginal sections, longitudinal connecting webs and lateral connecting webs of adjacent pairs of laterally connected bands, each laterally connected pair of bands having a pair of transversely extending finger tab means which include integral outer marginal portions of an associated lateral connecting web that extend between curvilinear inner marginal sections of said laterally connected bands on each side of said associated lateral connecting web, said finger tab means each including a curvilinear weakened area formed in the laterally connecting web inside of the outer marginal portions of the transversely extending finger tab means which comprises a reversely curving weakened line extension of the curvilinear inner marginal sections of each pair of laterally connected bands on each side of an associated lateral connecting web, whereby to provide readily deflectable finger tab means for gripping thereof by a user when the multi-packaging device is assembled to a plurality of containers.

2. The multi-packaging device as defined in claim 1 wherein the reversely curving weakened line extension formed in the laterally connecting web inside of the transversely extending finger tab means comprises a perforated extension of the curvilinear inner marginal sections of each pair of laterally connected bands on each side of an associated lateral connecting web.

3. The multi-packaging device as defined in claim 1 wherein each longitudinal connecting web has a centrally disposed transversely directed slit formed therein which is centrally disposed between adjacent bands, each transversely directed slit being spaced from the opposite marginal portions of the longitudinal connecting webs, whereby when adjacent bands in the longitudinal rows are separated from one another to form multi-packaging devices, said transversely directed slits cause separating or cutting forces acting on specific longitudinal connecting webs to follow the path of least resistance so as to provide uniform and equal separation of adjacent bands in said longitudinal rows of the multi-packaging device.

4. The multi-packaging device as defined in claim 3 wherein each of the lateral and longitudinal connecting webs have a weakened area in the central portions thereof throughout a substantial length thereof in order to provide independently flexible and/or foldable bands to facilitate assembly of the multi-packaging device to containers.

5. The multi-packaging device defined in claim 1 wherein said bands in the longitudinal rows define generally D-shaped holes which are in mirror image relationship to the generally D-shaped holes in the opposite longitudinal row.

6. The multi-packaging device as defined in claim 5 wherein each of said container encircling bands have inner and outer band segments, the inner band segment being attached to a lateral connecting web and extending between adjacent longitudinal connecting webs, said outer band segment also extending between adjacent longitudinal connecting webs on the opposite side of the band from the inner band segment, each of the bands being shaped to define a closed loop of four inner arcuate sections, the first inner arcuate section being formed in the inner band segment throughout its arcuate length and having a radius of curvature not greater than the radius of curvature of said containers, equal second and third inner arcuate sections extending from each end of the first inner arcuate sections and being formed generally within the confines of a longitudinal plane extending between adjacent longitudinal connecting webs, said second and third inner arcuate sections having equal radii of curvature which generally conform to the radius of said containers, the fourth inner arcuate section being formed in the outer band segment throughout its arcuate length and having a radius of curvature substantially greater than said containers, and said first and fourth inner arcuate sections being elongated to the circumferential shape of said containers while the second and third inner arcuate sections are being conformed to the circumferential shape of said containers during said elongation for applying said multi-packaging device to containers.

7. The multi-packaging device as defined in claim 6 wherein each of said second and third inner arcuate sections have a central portion conforming to the shape of the containers and outer portions which have a radius of curvature less than the radius of said containers, said outer portions of the second and third inner arcuate sections being slightly elongated while the central portion thereof is conformed to the shape of the containers during application of the multi-packaging device to said containers.

* * * * *